United States Patent [19]

Van Bouwel et al.

[11] 4,370,046

[45] Jan. 25, 1983

[54] METHOD AND APPARATUS FOR PROCESSING EXPOSED PHOTOGRAPHIC MATERIAL WITH BATH CONSTITUENT SUPPLY OUTLET OPENINGS AT DIFFERENT LEVELS

[75] Inventors: Leo Van Bouwel, Mortsel, Belgium; Erwin Geyken, Neubiberg, Fed. Rep. of Germany; Franz Ertl, Munich, Fed. Rep. of Germany; Adolf Fleck, Unterhaching, Fed. Rep. of Germany

[73] Assignee: AGFA-Gevaert Aktiengesellschaft, Leverkusen, Fed. Rep. of Germany

[21] Appl. No.: 287,570

[22] Filed: Jul. 28, 1981

[30] Foreign Application Priority Data

Jul. 29, 1980 [DE] Fed. Rep. of Germany ..... 3028675

[51] Int. Cl.[3] ..... G03D 3/06

[52] U.S. Cl. ..... 354/324; 366/136; 366/173

[58] Field of Search ..... 354/298, 320, 321, 322, 354/324, 328; 137/592; 141/100; 366/136, 160, 167, 172, 173

[56] References Cited

U.S. PATENT DOCUMENTS

| | | | |
|---|---|---|---|
| 3,243,268 | 3/1966 | Handlos et al. | 366/160 |
| 3,956,764 | 5/1976 | Schausberger | 354/298 |
| 4,230,569 | 10/1980 | Pfohl et al. | 366/173 |
| 4,245,034 | 1/1981 | Libicky et al. | 354/324 |

FOREIGN PATENT DOCUMENTS 3118 of 0000 European Pat. Off. .

*Primary Examiner*—L. T. Hix
*Assistant Examiner*—Alan Mathews
*Attorney, Agent, or Firm*—Kontler, Grimes & Battersby

[57] ABSTRACT

A processing bath is accommodated in a container having a pipe which communicates with the interior of the container at two different locations of the latter. The bath is circulated through this pipe and a pump for circulation of the bath is provided in the pipe. Several tubes extend into the bath and each tube has an outlet opening in the region of the inlet end of the circulation pipe. The outlet openings of the tubes are all located at different levels below the surface of the bath. The tubes are respectively connected with supply pumps which, in turn, are connected with respective sources of concentrates and a diluent required to maintain the strength of the bath within predetermined limits. A sensor senses the amount of material processed in the bath and causes the supply pumps to pump the concentrates and diluent into the bath in dependence upon the amount of material processed. Since the concentrates and diluent enter the bath at different levels, they mix with the bath before coming into contact with one another. This prevents undesirable chemical reactions which might otherwise occur between the various constituents of the bath. The admission of the concentrates and diluent into the bath in the region of the inlet end of the circulation pipe insures rapid mixing of the concentrates and diluent with the bath so that the homogeneity of the latter is maintained.

24 Claims, 1 Drawing Figure

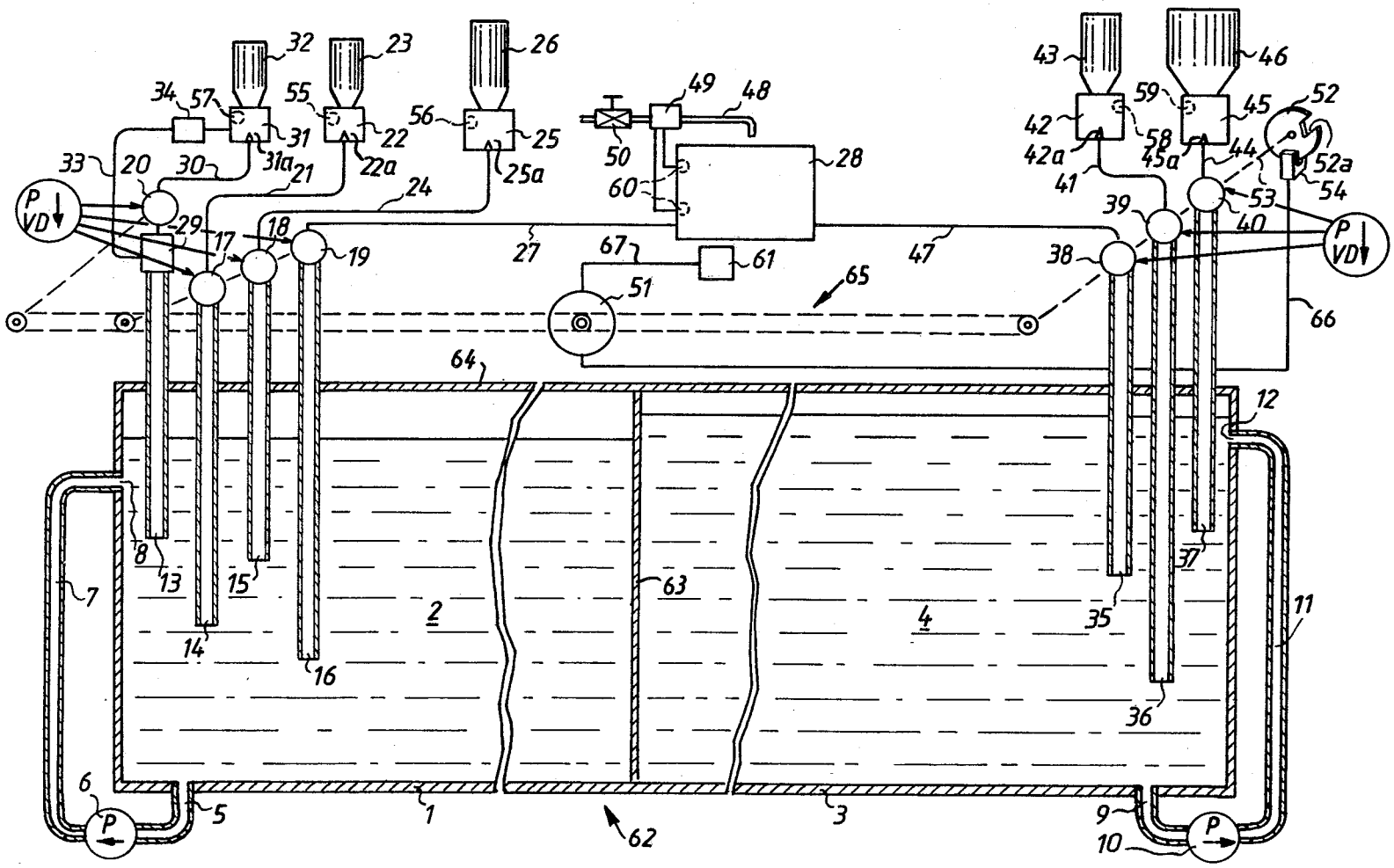
P
VD
P
VD
P
P

METHOD AND APPARATUS FOR PROCESSING EXPOSED PHOTOGRAPHIC MATERIAL WITH BATH CONSTITUENT SUPPLY OUTLET OPENINGS AT DIFFERENT LEVELS

BACKGROUND OF THE INVENTION

The invention relates generally to the processing of materials.

More particularly, the invention relates to the processing of exposed photographic paper, especially film.

A known apparatus for the development of photographic paper or film includes a processing tank for a processing bath and an arrangement for achieving and maintaining the required strength or concentration of the bath. This arrangement includes individual storage vessels for concentrates and a diluent as well as pumps for conveying the concentrates and diluent to the processing tank in dependence upon the throughput of the photographic paper or film.

The European patent application No. 3 118 describes an apparatus of this type in which the concentrates are admitted into the processing tank above the surface of the bath. This is achieved via pipes having outlet openings located at the same level above the surface of the bath. Such a procedure leads to the danger of the concentrates mixing with one another and undergoing undesired chemical reactions before reaching the bath. Furthermore, a hazard exists for the operator since the concentrates may rebound and spray the operator when impinging upon the surface of the bath. In addition, the operator is subjected to odors from the concentrates. Also, satisfactory processing results cannot be obtained inasmuch as the fresh concentrates fed into the processing tank are initially located in the upper region of the tank.

OBJECTS AND SUMMARY OF THE INVENTION

It is an object of the invention to provide a method and apparatus for processing materials which while reducing the chances of undesired chemical reactions, make it possible to maintain the strength of the processing bath.

Another object of the invention is to provide a method and apparatus for processing materials which while reducing the danger to operating personnel, make it possible to maintain the strength of the processing bath.

An additional object of the invention is to provide a method and apparatus for processing materials which while reducing objectionable odors, make it possible to maintain the strength of the processing bath.

It is also an object of the invention to provide a method and apparatus for processing materials which while improving processing results, make it possible to maintain the strength of the processing bath.

Still another object of the invention is to improve the known apparatus described above so that better working conditions for the operating personnel are achieved and better processing results are obtained by virtue of a more uniform concentration of the processing bath.

The preceding objects, and others which will become apparent, are achieved in accordance with the invention.

The invention provides a method of processing material which involves at least partially immersing the material in a processing bath and maintaining the strength of the bath within predetermined limits by supplying a plurality of constituents of the bath to the latter at different levels below the surface of the bath.

An apparatus according to the invention comprises container means accommodating a processing bath and a plurality of sources of different constituents of the bath. Supply means for supplying the constituents to the bath includes supply conduits which project into the bath and respectively communicate with the sources of the constituents. A characteristic feature of the apparatus resides in that the supply conduits have respective outlet openings at different levels below the surface of the bath.

The invention achieves the result that the constituents, e.g., concentrates, supplied to the bath initially mix with the bath. Only after mixing with the bath do the various constituents mix with one another. Thus, undesired reactions of the constituents with each other may be avoided. Likewise, the hazards and odors to which operating personnel were previously exposed may be avoided in accordance with the invention.

A preferred embodiment of the method contemplates circulation of the bath, that is, the withdrawal of a portion of the bath from the latter at a predetermined location of the bath and readmission of this portion of the bath into the latter at another location of the bath. Here, the constituents are supplied to the bath in the region of the predetermined withdrawal location. In a preferred embodiment of the apparatus, this is achieved by providing a circulation conduit which communicates with the container means for the bath and has an inlet end located in the region of the outlet openings of the supply conduits. Such circulation enhances mixing of the constituents with one another after the constituents have mixed with the bath.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE schematically illustrates an apparatus in accordance with the invention for developing exposed photographic materials.

DESCRIPTION OF THE PREFERRED EMBODIMENTS

An apparatus according to the invention is shown in the FIGURE and is here assumed to be an apparatus for the development of exposed photographic paper, especially film. The apparatus includes a processing tank 62 which is divided into two separate compartments 1 and 3 by a dividing wall 63. The compartment 1 contains developer 2 while the compartment 3 contains fixer 4.

A pipe 7 for circulation of the developer 2 connects an outlet 5 in the bottom of the compartment 1 with an inlet 8 in the side of the compartment 1. The inlet 8 is located just below the surface of the developer 2. A pump 6 for forced circulation of the developer 2 is arranged in the pipe 7.

Similarly, a pipe 11 for circulation of the fixer 4 connects an outlet 9 in the bottom of the compartment 3 with an inlet 12 in the side of the compartment 3. The inlet 12 is again located below the surface of the fixer 4. A pump 10 for forced circulation of the fixer 4 is arranged in the pipe 11.

The tank 62 has a cover 64 which is provided with a series of four openings in the region of the compartment 1. Four tubes 13, 14, 15 and 16 extend through respective ones of the openings in the cover 64 and project into the developer 2. The lower ends of the tubes 13–16 have respective outlet openings and the tubes 13–16 are so arranged that the outlet openings of the various tubes 13–16 are located at different levels below the surface of the developer 2. In the illustrated exemplary embodiment, the outlet openings of the tubes 14 and 16 are substantially deeper than the outlet openings of the tubes 13 and 15. The outlet openings of the tubes 13–16 are located essentially directly above the outlet 5 in the bottom of the compartment 1, that is, are located in the region of the outlet 5.

The tube 13 is connected with the discharge end of a pump 20 via a pressure-responsive valve 29. The pump 20, in turn, is connected with a temporary storage vessel 31 for a starter concentrate by means of a pipe 30. The storage vessel 31 receives an inverted bottle 32 of the starter concentrate. A pipe 33 with an electromagnetic valve 34 connects the pressure-responsive valve 29 with the storage vessel 31.

The tubes 14 and 15 are connected with the discharge ends of respective pumps 17 and 18 which, in turn, are respectively connected with temporary concentrate storage vessels 22 and 25 via pipes 21 and 24. The storage vessels 22 and 25 respectively receive inverted bottles 23 and 26 of concentrate.

The tube 16 is connected with the discharge end of a pump 19. The pump 19, in turn, is connected with a temporary water storage vessel 28 by means of a pipe 27. Fresh water is supplied to the storage vessel 28 from a line 48 which is provided with a pressure-reducing valve 50. The line 48 is connected with a continuous source of water such as a water supply network.

The concentrate storage vessels 22, 25 and 31 are equipped with opening mechanisms for the concentrate bottles 23, 26 and 32. The opening mechanisms may, for example, be in the form of pins 22*a*, 25*a* and 31*a* which are centrally located at the bottoms of the respective storage vessels 22, 25 and 31 and serve to open valves or puncture protective membranes of the bottles 23, 26 and 32 when these are placed on the storage vessels 22, 25 and 31.

The concentrate storage vessels 22, 25 and 31 are further equipped with respective level detectors 55, 56 and 57 which generate acoustical and/or optical warning signals when the concentrate level in the corresponding storage vessel 22, 25 or 31 falls below a predetermined, minimum level. The water storage vessel 28, on the other hand, is provided with a pair of detectors 60 which are connected with a magnetic valve 49 arranged in the water supply line 48. The detectors 60 regulate the magnetic valve 49 so that the water level in the storage vessel 28 is maintained within predetermined upper and lower limits. Thus, when the water level in the storage vessel 28 is too low, the detectors 60 cause the magnetic valve 49 to open so that water flows into the storage vessel 28. Once the water reaches a predetermined, maximum level, the detectors 60 cause the magnetic valve 49 to close thereby stopping the flow of water into the storage vessel 28.

The cover 64 of the tank 62 is further provided with a series of three openings in the region of the compartment 3. Three tubes 35, 36 and 37 extend through respective ones of these openings and project into the fixer 4. The lower ends of the tubes 35–37 have respective outlet openings and the tubes 35–37 are so arranged that the outlet openings of the various tubes 35–37 are located at different levels below the surface of the fixer 4. In the exemplary embodiment illustrated, the outlet opening of the tube 36 is located farther below the surface of the fixer 4 than the outlet openings of the tubes 35 and 37. The outlet openings of the tubes 35–37 are positioned in the region above the outlet 9 in the bottom of the compartment 3.

The tubes 36 and 37 are connected with the discharge ends of respective pumps 39 and 40 which, in turn, are respectively connected with temporary concentrate storage vessels 42 and 45 via pipes 41 and 44. The storage vessels 42 and 45 respectively receive inverted bottles 43 and 46 of concentrate.

The tube 35 is connected with the discharge end of a pump 38. The pump 38, in turn, is connected with the temporary water storage vessel 28 by means of a pipe 47.

The concentrate storage vessels 42 and 45 are provided with opening mechanisms which may be in the form of pins 42*a* and 45*a* as described previously for the storage vessels 22, 25 and 31. The concentrate storage vessels 42 and 45 are also equipped with respective level detectors 58 and 59 which generate acoustical and/or optical warning signals when the concentrate level in the corresponding storage vessel 42 or 45 falls below a predetermined, minimum value.

The pumps 17–20 and 38–40 are of the variable delivery type and the pumping capacities or outputs of the pumps 17–20 and 38–40 can be adjusted individually. The pumps 17–20 and 38–40 are connected with a common drive 51 via schematically illustrated connecting elements 65 including a drive shaft 53. An indexing disc 52 having a notch 52*a* is arranged on the drive shaft 53 and rotates through a light barrier 54. The light barrier 54 is connected with the drive 51 via an electrical connection 66.

A sensor 61 for electrically sensing the area of the film admitted into the tank 62 is connected with the drive 51 by means of an electrical connection 67. The sensor 61 may be arranged to sense the film as it is being conveyed to the tank 62 by a non-illustrated conveying system. The sensor 61 generates a signal, and the drive 51 continues to run, whenever film is being fed to the tank 62. When film is no longer being fed to the tank 62, the sensor 61 ceases to generate a signal and the light barrier 54 then causes the drive 51 to shut off.

In operation, the concentrate bottles 23, 26, 32, 43 and 46 are uncapped and placed on the respective storage vessels 22, 25, 31, 42 and 45 in the inverted positions shown. The pins 22*a*, 25*a*, 31*a*, 42*a* and 45*a* in the storage vessels 22, 25, 31, 42 and 45 unseal the bottles 23, 26, 32, 43 and 46. The contents of the latter now flow into the storage vessels 22, 25, 31, 42 and 45 until the concentrates in the storage vessels 22, 25, 31, 42 and 45 reach respective levels which inhibit further flow. Additional concentrate can automatically flow out of the bottles 23, 26, 32, 43 and 46 as necessary in accordance with the principle of communicating vessels. Complete emptying of the bottles 23, 26, 32, 43 and 46 is assured by the inverted positions of the latter and the bottles 23, 26, 32, 43 and 46 can be replaced when warning signals are issued by the level detectors 55–59.

The pressure-reducing valve 50 in the water supply line 48 is opened and the water storage vessel 28 is filled. The level detector 60 regulates the magnetic valve 49 in the water supply line 48 so that sufficient water is always present in the storage vessel 28.

Film is now transported into the tank 62 for processing. After approximately 1 square meter of film has been processed, the sensor 61 sends a signal to the drive 51 which activates the latter so that quantities of concentrate and water corresponding to those required to process 1 square meter of film are fed into the compartments 1 and 3. If no further signal is issued by the sensor 61, the light barrier 54 shuts off the drive 51 after the indexing disc 52 has completed a predetermined number of revolutions which is related to the area of the film processed. In the present case, the indexing disc 52 completes three revolutions for the square meter of film processed.

The pumps 17–20 and 38–40 are arrested in their starting positions when the drive 51 is shut off by the light barrier 54.

During operation of the pumps 17–20 and 38–40, water and concentrate are admitted into the compartments 1 and 3 via the respective sets of tubes 13–16 and 35–37 and are circulated by the respective circulation systems 6, 7 and 10, 11. Since the outlet openings of the sets of tubes 13–16 and 35–37 are located at different levels below the surfaces of the developer 2 and the fixer 4, respectively, the water and concentrates initially mix with the surrounding developer 2 and fixer 4 and only thereafter gradually mix with one another. The circulation which takes place in the region where the water and concentrate are supplied to the developer 2 and fixer 4 causes the fresh water and concentrate to rapidly mix with the bulks of the developer 2 and fixer 4 so that the processing conditions are always uniform.

As long as the replenishing or metering system described above is regulated by sensing the area of the film processed, that is, in dependence upon the film throughput, starter concentrate from the bottle 32 is not supplied to the compartment 1. In such a case, the electromagnetic valve 34 is open so that the starter concentrate in the storage vessel 31 is circulated through the pipes 30 and 33. The pressure-responsive valve 29 prevents the starter concentrate from flowing into the developer 2 since the starter concentrate is free to flow through the pipes 30 and 33 and the pump 20 is therefore unable to exert sufficient pressure to open the pressure-responsive valve 29 for flow of the starter concentrate into the tube 13. However, if the apparatus has been idle for an extended period of time during which the developer 2 has undergone evaporation and oxidation, the electromagnetic valve 34 is closed when the apparatus is started. The pump 20 can now exert sufficient pressure on the pressure-responsive valve 29 to open the same for flow of the starter concentrate into the tube 13 and the starter concentrate is admitted into the compartment 1. The addition of starter concentrate may be necessary or advantageous after extended idle periods since consistent processing results may otherwise not be achieved due to the evaporation and oxidation of the developer 2 which take place during such periods.

It will be understood that one or both of the detectors 60 may be designed to emit an acoustical and/or optical signal. For example, the upper one of the detectors 60 may be arranged to emit such a signal when the water level in the storage vessel 28 exceeds a predetermined upper limit so that the supply of water from the water supply network may be manually discontinued.

The operation of the sensor 61 is described in U.S. Pat. No. 3,956,764, for example.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for processing material, particularly exposed photosensitive material, comprising:
   (a) container means accommodating a processing bath;
   (b) a plurality of sources of different constituents of said bath;
   (c) supply means for supplying said constituents to said bath, said supply means including supply conduits which project into said bath and respectively communicate with said sources, said supply conduits having respective outlet openings at different levels below the surface of said bath; and
   (d) a bath circulation conduit communicating with said container means, said circulation conduit having an inlet end which is located in the region of said outlet openings.

2. An apparatus as defined in claim 1, comprising circulating pump means for circulating said bath.

3. An apparatus as defined in claim 1, wherein said supply means comprises supply pump means for pumping said constituents from said sources to said bath.

4. An apparatus as defined in claim 3, wherein said supply pump means comprises separate and adjustable supply pumps for said constituents, said supply pumps being respectively set at fixed outputs corresponding to the amounts of the respective constituents to be supplied to said bath, and said supply pumps being connected to a common drive.

5. An apparatus as defined in claim 4, comprising sensing means for sensing the amount of material processed in said bath and regulating said drive in dependence upon the amount of material processed.

6. An apparatus as defined in claim 4, comprising arresting means for stopping said drive after a predetermined number of revolutions thereof.

7. An apparatus as defined in claim 1, comprising sensing means for sensing the amount of material processed in said bath and causing said constituents to be supplied to said bath in dependence upon the amount of material processed.

8. An apparatus as defined in claim 1, wherein one of said constituents comprises a concentrate and another of said constituents comprises a diluent.

9. An apparatus as defined in claim 1, wherein at least one of said sources comprises a temporary storage vessel for the respective constituent.

10. Apparatus for processing material, particularly exposed photosensitive material, comprising:
   (a) container means accommodating a processing bath;
   (b) a plurality of sources of different constituents of said bath, at least one of said sources comprising a temporary storage vessel for the respective constituent and said vessel being arranged to receive a sealed container of the respective constituent and including opening means for opening the sealed container; and (c) supply means for supplying said constituents to said bath, said supply means including supply conduits which project into said bath and respectively communicate with said sources, and said supply conduits having respective outlet openings at different levels below the surface of said bath.

11. An apparatus as defined in claim 10, comprising a detector for generating an acoustical and/or optical signal when the respective constituent in said storage vessel falls below a predetermined level.

12. An apparatus as defined in claim 10, comprising an additional processing bath; and wherein said storage vessel communicates with both of said baths.

13. An apparatus as defined in claim 12, wherein said storage vessel accommodates water.

14. An apparatus as defined in claim 10, comprising conduit means for continuously supplying the respective constituent to said storage vessel, valve means for controlling the flow of the respective constituent through said conduit means, and detector means connected with said valve means to maintain the level of the respective constituent in said storage vessel between predetermined upper and lower limits.

15. An apparatus as defined in claim 14, wherein said valve means comprises an electromagnetic valve.

16. An apparatus as defined in claim 1, wherein said bath comprises photographic developer.

17. An apparatus as defined in claim 1, wherein said bath comprises photographic fixer.

18. A method of processing material, particularly exposed photosensitive material, comprising the steps of:

(a) at least partially immersing material to be processed in a processing bath;

(b) maintaining the strength of said bath within predetermined limits by supplying a plurality of constituents of said bath to the latter at different levels below the surface of the bath;

(c) withdrawing a portion of said bath from the latter at a predetermined location of said bath; and (d) readmitting said portion of said bath to the latter at another location of said bath, said constituents being admitted into said bath in the region of said predetermined location.

19. A method as defined in claim 18, wherein said constituents are supplied to said bath in automatic response to the amount of material processed.

20. A method as defined in claim 18, wherein one of said constituents comprises a concentrate and another of said constituents comprises a diluent.

21. A method as defined in claim 20, wherein said diluent comprises water.

22. A method as defined in claim 18, wherein said material comprises exposed photographic paper and said bath comprises a photographic developer.

23. A method as defined in claim 18, wherein said material comprises exposed photographic paper and said bath comprises a photographic fixer.

24. A method as defined in claim 18, wherein said material comprises exposed photographic film.

* * * * *